United States Patent [19]

Haddock

[11] 4,203,259

[45] May 20, 1980

[54] APPARATUS FOR EDGING OPHTHALMIC LENSES

[75] Inventor: Fred Haddock, Muskogee, Okla.

[73] Assignee: Coburn Optical Industries, Inc., Muskogee, Okla.

[21] Appl. No.: 906,883

[22] Filed: May 17, 1978

[51] Int. Cl.[2] ..... B24B 9/14

[52] U.S. Cl. ..... 51/97 NC; 51/101 LG; 51/106 LG; 51/165.71

[58] Field of Search ..... 51/97 NC, 101 R, 101 LG, 51/165 TP, 165.71, DIG. 32, 97 R, 106 LG

[56] References Cited

U.S. PATENT DOCUMENTS

| | | | |
|---|---|---|---|
| 1,171,027 | 2/1916 | Cossman | 51/101 LG |
| 1,502,990 | 7/1924 | Kiefer | 51/101 R |
| 3,894,361 | 7/1975 | Georgiadis et al. | 51/101 LG |
| 3,913,274 | 10/1975 | Raiford et al. | 51/165.71 |
| 4,005,552 | 2/1977 | Hoglund et al. | 51/DIG. 32 |
| 4,027,245 | 5/1977 | Bourrat et al. | 51/165.71 |

FOREIGN PATENT DOCUMENTS

| | | | |
|---|---|---|---|
| 557278 | 11/1943 | United Kingdom | 51/101 LG |

*Primary Examiner*—Harold D. Whitehead
*Assistant Examiner*—K. Bradford Adolphson
*Attorney, Agent, or Firm*—John J. Byrne; Edward E. Dyson

[57] ABSTRACT

An apparatus for simultaneously grinding a peripheral shape and edge surface upon a pair of ophthalmic lenses including an abrading wheel and first and second floating heads for rotatably supporting a pair of ophthalmic lenses on either side of the abrading wheel. The lenses are biased toward the wheel and are incrementally rotated about mutually parallel axes which lie parallel with a central longitudinal axis of the abrading wheel. An electronic control system is operably connected to each of the lenses and serves to control incremental rotation of each of the lenses as well as lateral engagement of the lenses with the central abrading wheel.

11 Claims, 22 Drawing Figures

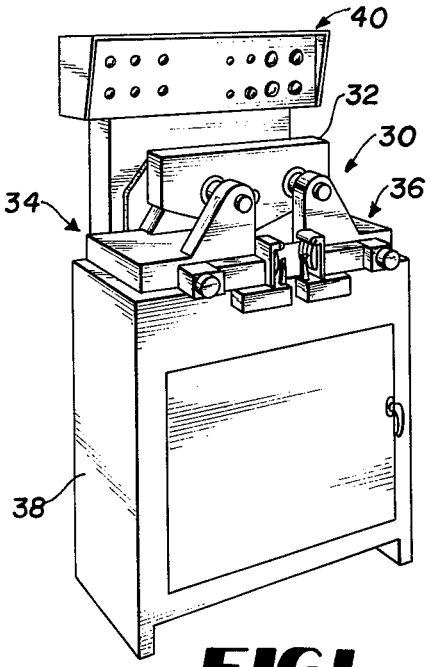
FIG.1
FIG.7
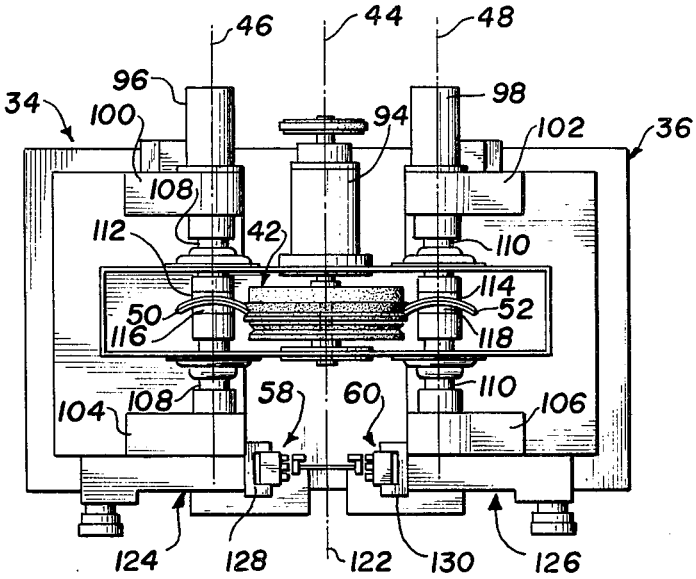
FIG.6
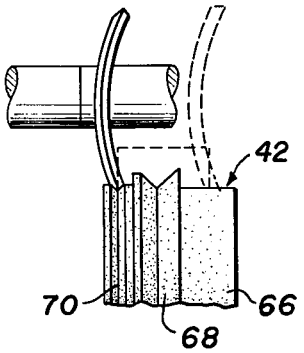
FIG.2
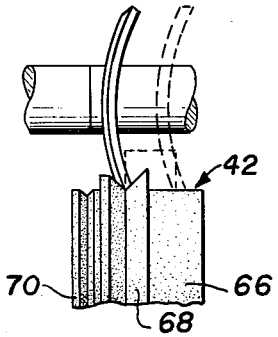
FIG.3
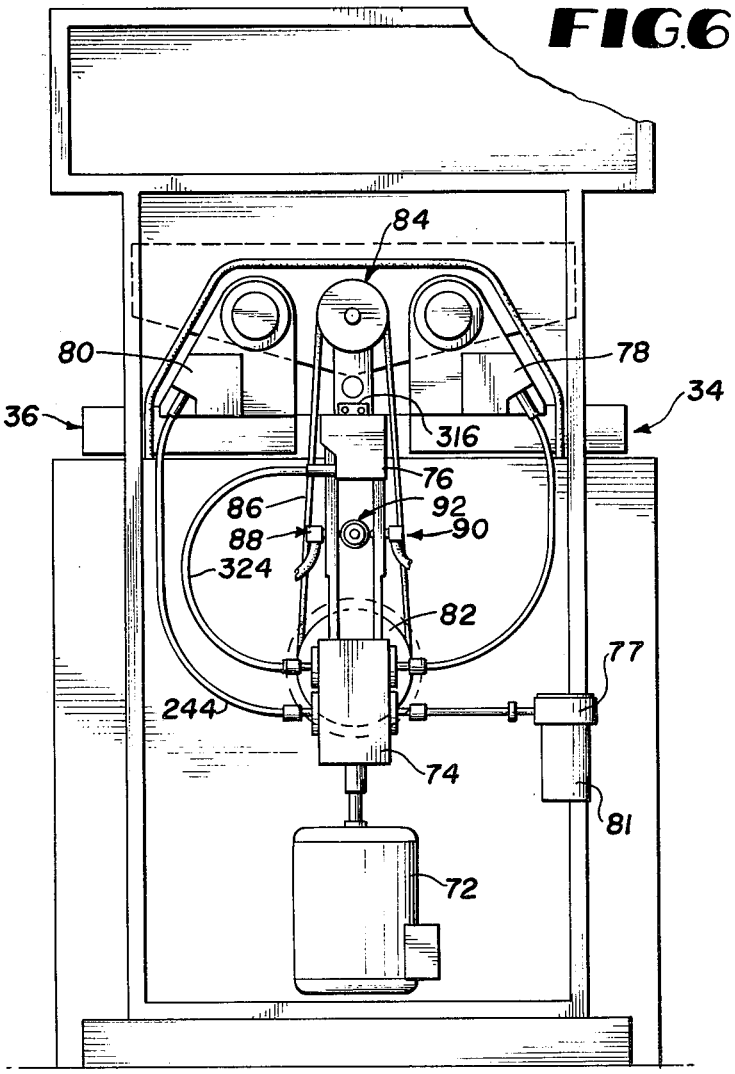

FIG.20
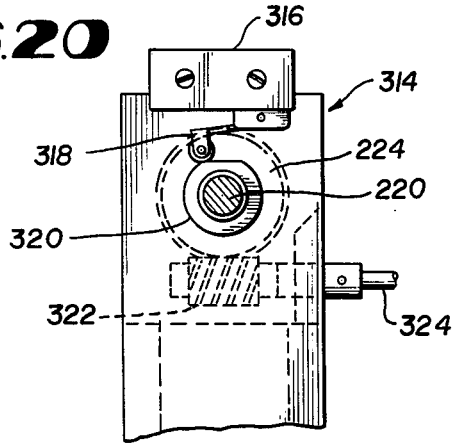
FIG.21
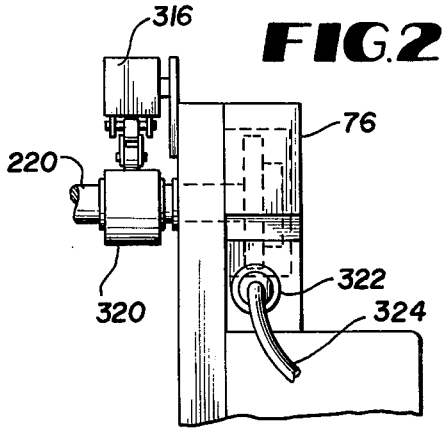
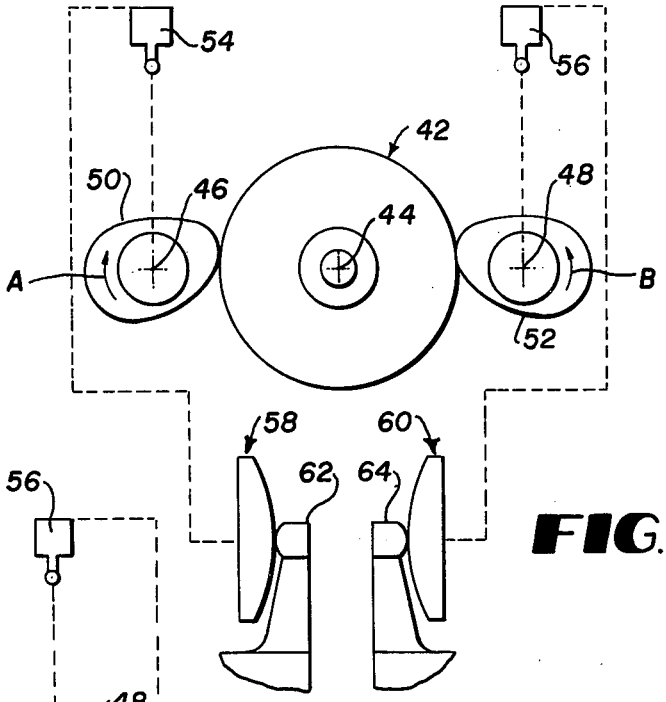
FIG.4
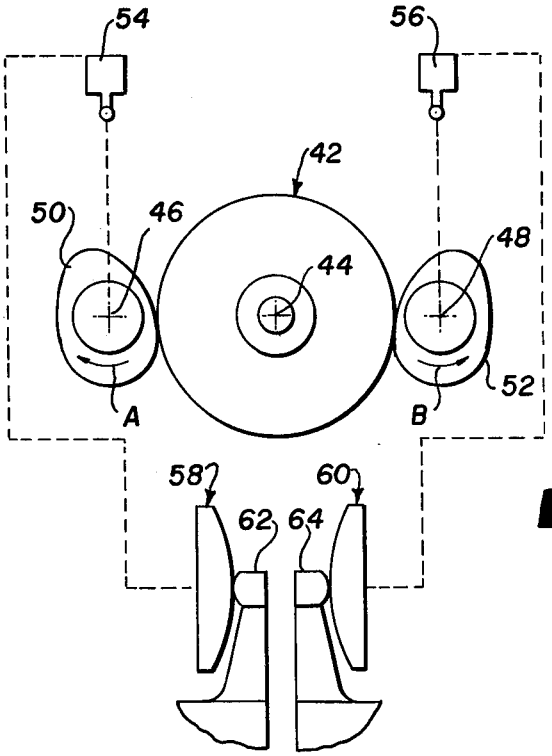
FIG.5

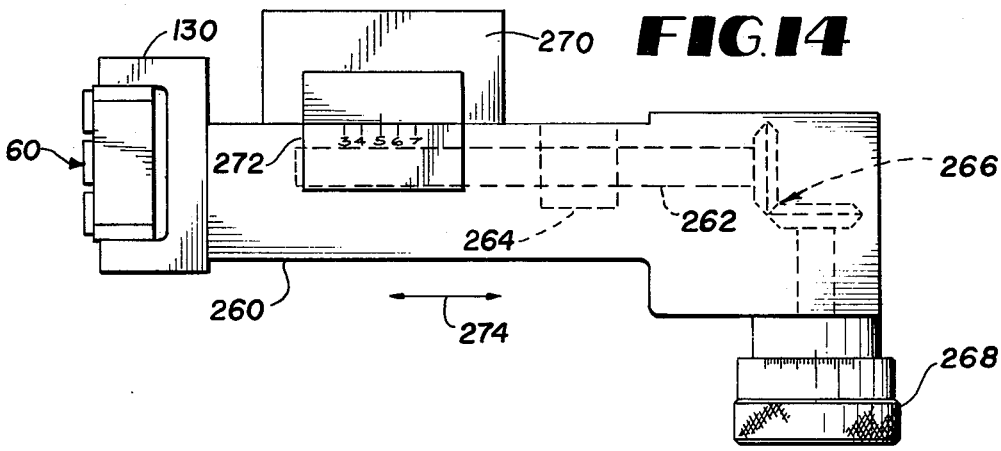
FIG. 14
FIG. 10
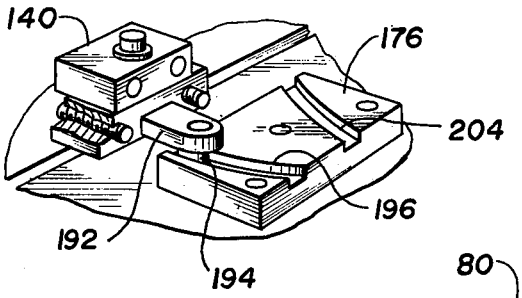
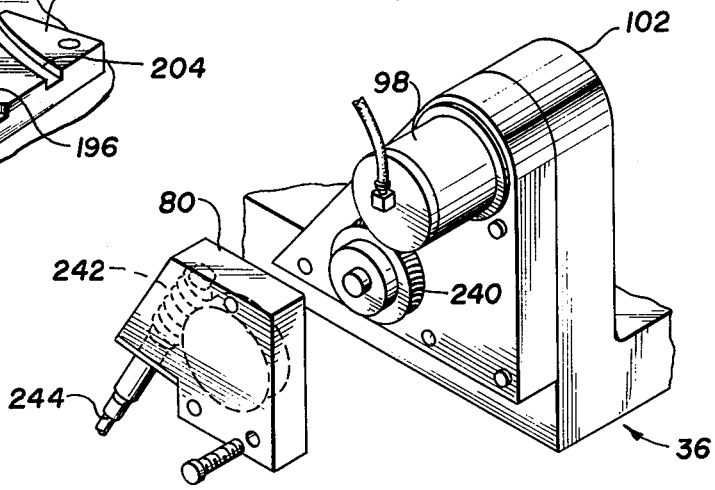
FIG. 12
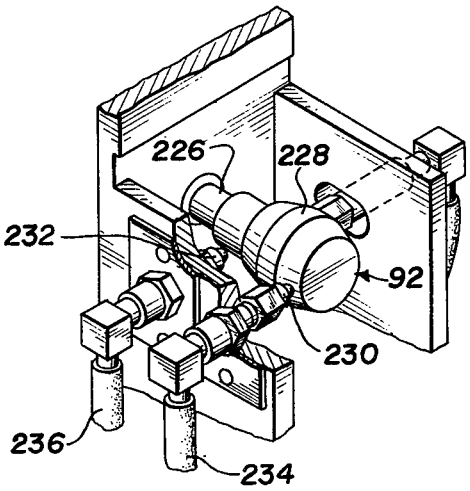
FIG. 13

APPARATUS FOR EDGING OPHTHALMIC LENSES

BACKGROUND OF THE INVENTION

This invention relates to an apparatus for grinding an edge shape and peripheral surface configuration upon ophthalmic lenses.

The art of preparing ophthalmic lenses from glass blanks entails two major processes. First, the circular lens blanks are surface ground with a prescriptive front and back curvature to provide a desired optic quality or characteristic and thus enhance the vision of an ultimate wearer. Secondly, the lenses are ground to a desired edge shape to fit a preselected frame. Additionally, the peripheral edge surface of the lens is typically beveled or finished to cooperate with a reciprocal bevel on an interior peripheral surface of a frame in order to hold the lenses within the frame.

In the past at least one process of lens edging has been achieved by mounting a single lens upon a laterally fixed spindle or chucking mechanism and advancing an abrading wheel into lateral contact with the lens. The process is then repeated on an additional blank to produce a matching set or pair of lenses.

In another previously known process a lens to be edge ground is horizontally mounted about a vertical axis. A pair of grinding wheels are vertically mounted for rotation on either side of the lens for selective advancement into grinding engagement with the central lens. Each of the grinding wheels is fashioned with an oppositely sloping peripheral surface. Accordingly, one wheel contacts a front peripheral portion of the lens and another wheel contacts a back peripheral portion of the lens. In combination the two grinding wheels form a beveled peripheral edge on the lens. Lateral control of the abrading wheels is achieved by a pair of conical cam followers which ride against a generally disc shaped cam. Once completed, the lens is removed and the process is repeated on a second lens blank to produce a pair.

Although lens edging equipment of the foregoing and similar designs have received at least a degree of attention and acceptance in the art several significant difficulties exist. In this connection, edge grinding a pair of lenses on presently known machines is somewhat time consuming and requires a degree of operator attention and control.

Additionally, these previously known edging devices are limited to grinding a single lens at one time and thus lack a certain degree of uniformity and symmetry desired of a pair of lenses.

Further, the foregoing known machines do not provide a capability of edging a pair of lenses in a manner to sequentially remove glass and then fine grinding a desired edge configuration.

Still further, the known prior art devices do not exhibit a capability for simultaneously grinding a pair of lenses and facilely and independently varying the lens size for a given lens shape.

A significant advance was achieved in the art with the conception and reduction to practice of a dual headed edger such as disclosed in an application entitled METHOD AND APPARATUS FOR EDGING OPHTHALMIC LENSES by Messrs. Boyd Neisler and Joseph Stith commonly assigned with the subject application and filed on Jan. 24, 1978 as U.S. Ser. No. 871,871.

Although a complete description of the above invention may be had by referring to said patent, in brief sum, this invention entails an abrading wheel and first and second floating heads for rotatably supporting a pair of ophthalmic lenses on either side of the abrading wheel. The lenses are biased toward the wheel and are incrementally rotated about mutually parallel axes which lie parallel with a central longitudinal axis of the abrading wheel. A cam control system is operably connected to the lenses and serves to control incremental rotation of each of the lenses as well as lateral engagement of the lenses with the central abrading wheel. The Neisler et al. method includes the steps of mounting a pair of ophthalmic lenses upon axes parallel with a central axis of an abrading wheel, biasing the lenses toward the abrading wheel and controlling rotation of the lenses to be edge ground with a cam control system to produce a desired lens peripheral shape and edge surface.

Although introduction of the Neisler et al. system represented a singular advance in the art, room for further improvement remains. In this connection, the wide variety of glasses frames today requires a lens finisher to stock literally thousands of different mechanical cams (or patterns). It is estimated that an operator may use from time-to-time approximately 8,000 to 10,000 different patterns. This large variety of shapes requires a library file which is difficult and time consuming to maintain. Moreover, a complete library of accurately dimensioned patterns represents a significant initial capital investment.

The difficulties suggested in the proceeding are not intended to be exhaustive, but rather are among many which may tend to reduce the effectiveness and user satisfaction of prior lens edging methods and apparatus. Other noteworthy problems may also exist; however, those presented above should be sufficient to demonstrate that ophthalmic lens edging machines and techniques appearing in the past will admit to worthwhile improvement.

OBJECTS OF THE INVENTION

It is therefore a general object of the invention to provide a novel apparatus for edging ophthalmic lenses which will obviate or minimize difficulties or the type previously described.

It is a specific object of the invention to provide a novel apparatus for edging at least one ophthalmic lense which will significantly reduce the amount of time, expense and effort needed to maintain a pattern library.

It is another object of the invention to provide a novel apparatus which will enable an operator to facilely call out a lens shape without locating, installing and setting up a lens pattern or cam.

It is still another object of the invention to provide a novel apparatus for edging at least one ophthalmic lense wherein data storage facilities for lens shapes may be enhanced It is a further object of the invention to provide a novel apparatus for simultaneously edge grinding a pair of ophthalmic lenses wherein the finish shape or bevel may be accurately and reliably controlled with a minimum of operator attention and training.

It is yet a further object of the invention to provide a novel apparatus for simultaneously edge grinding a pair of ophthalmic lenses which will exhibit the advantages of the previously described Neisler et al invention without requiring use of mechanical cams (or patterns) in the system.

THE DRAWINGS

Other objects and advantages of the present invention will become apparent from the following detailed description of a preferred embodiment thereof taken in conjunction with the accompanying drawings, wherein:

FIG. 1 is an axonometric view of a dual head floating edge grinder for ophthalmic lenses which is controlled in accordance with a preferred embodiment of the invention;

FIG. 2 is a schematic representation of a rough shaping operation and a final bevel edge grinding step for an ophthalmic lens;

FIG. 3 is another schematic view similar to FIG. 2 of a coarse shaping operation followed by a final alternate bevel edge grind;

Figure 16:
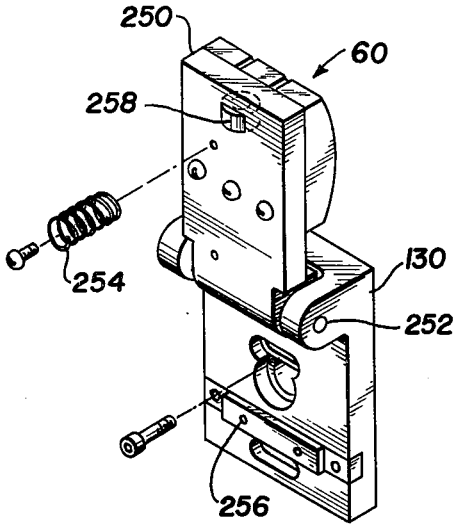
Figure 15:
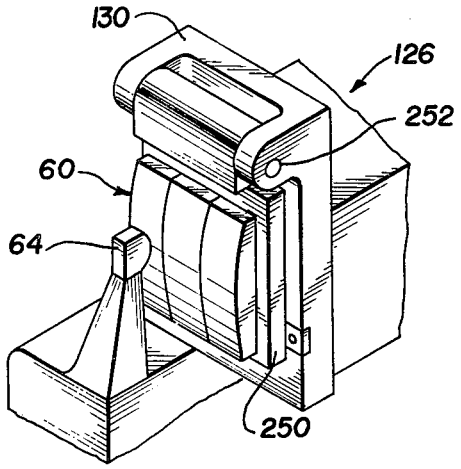
Figure 8:
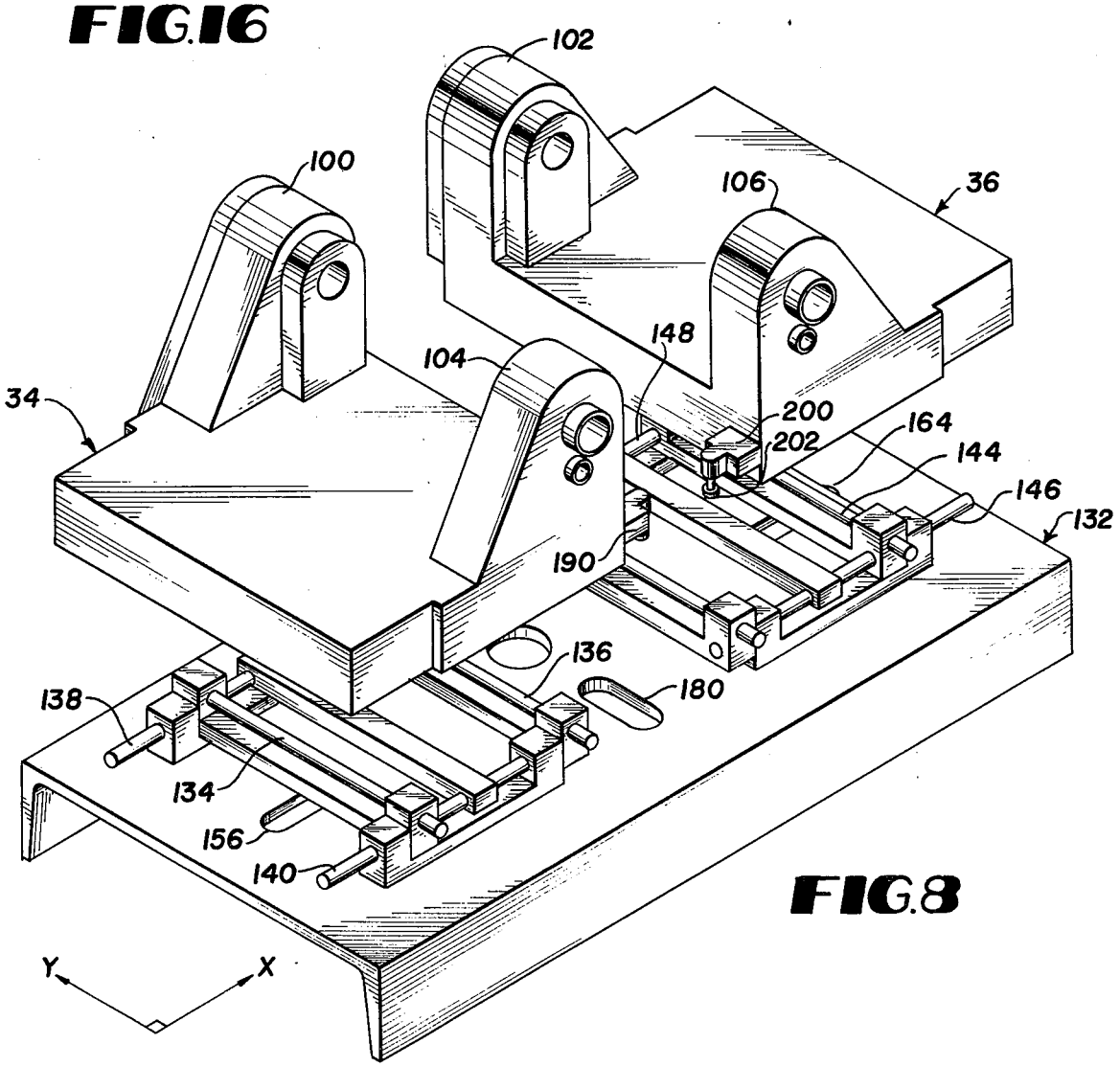
Figure 9:
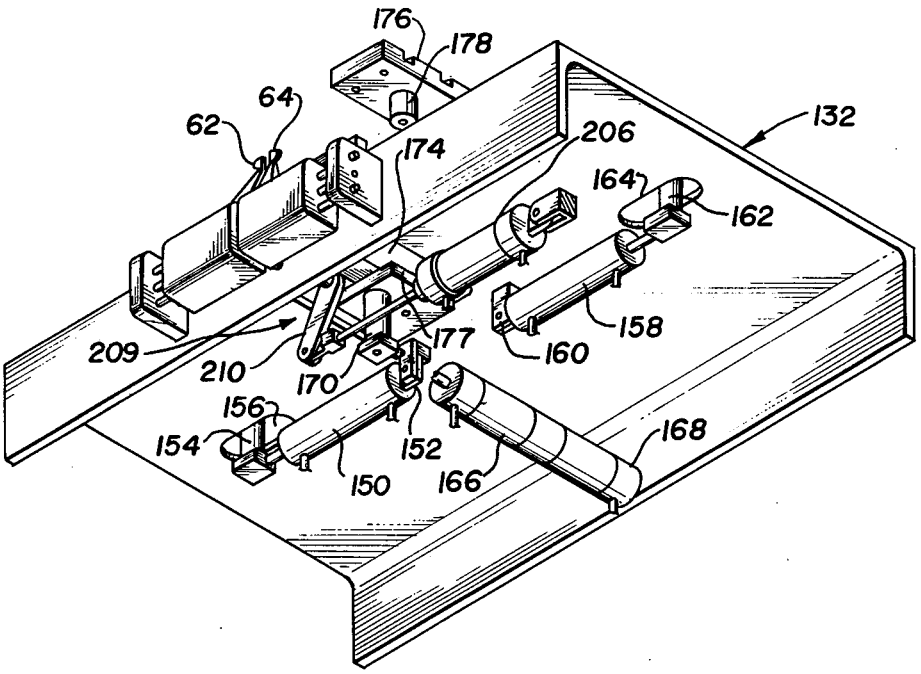
Figure 11:
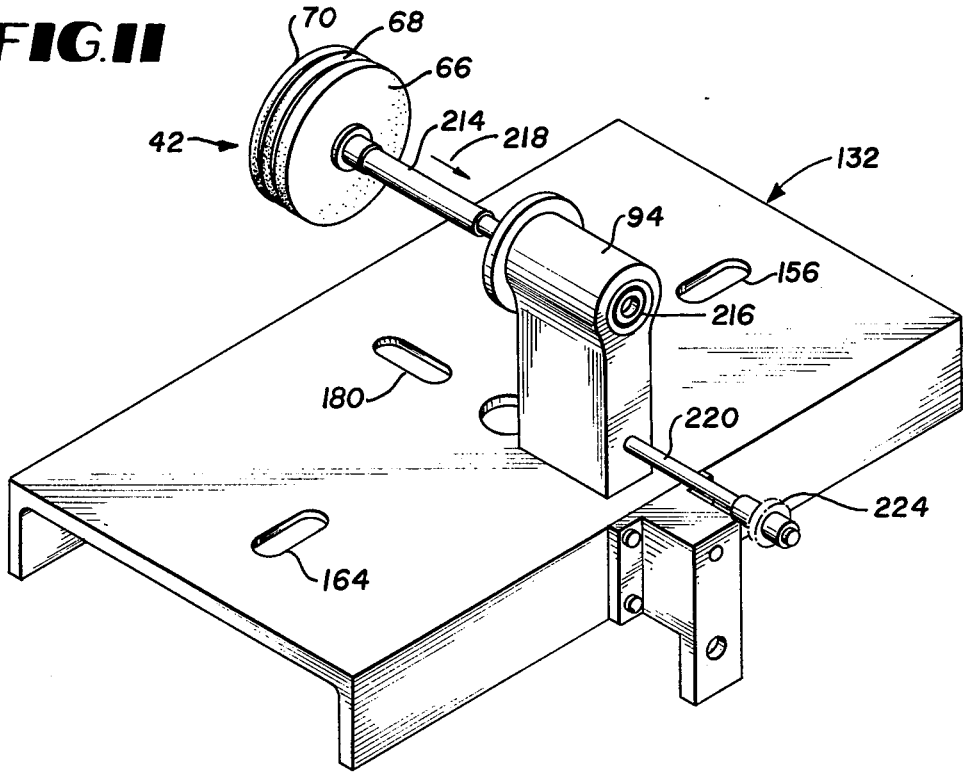
Figure 17:
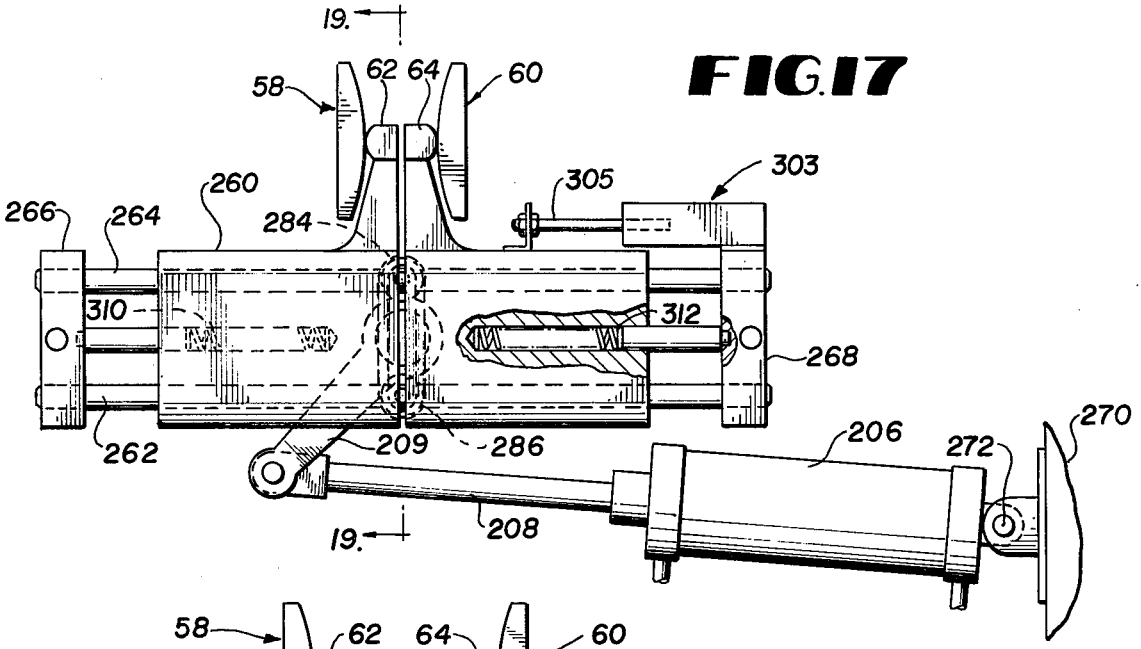
Figure 18:
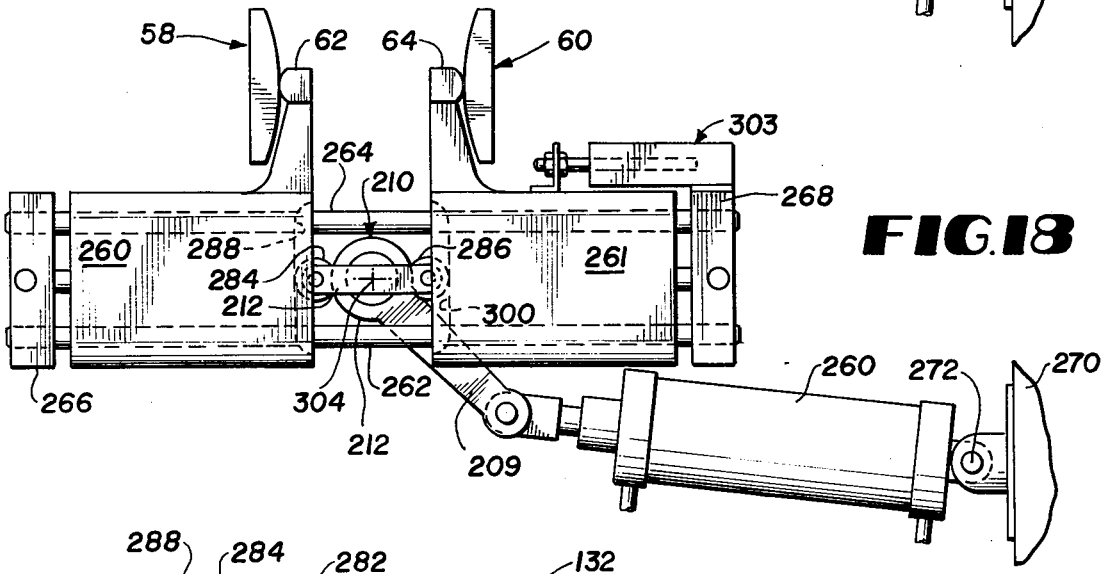
Figure 19:
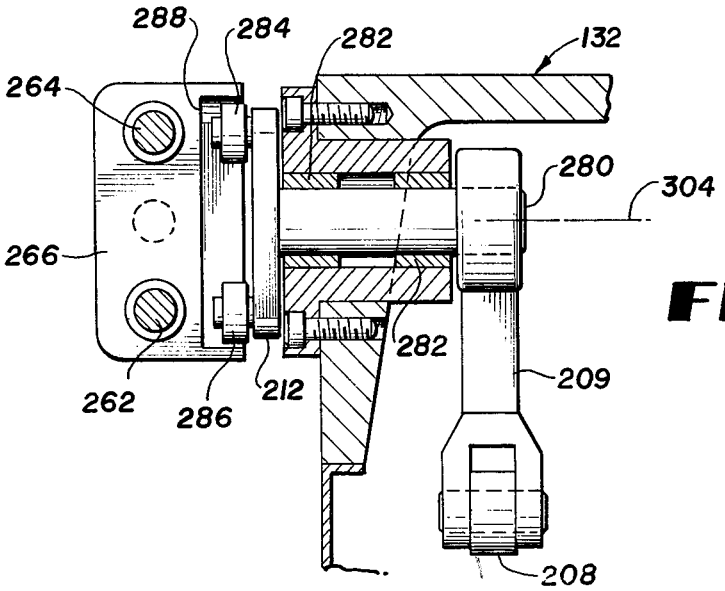
Figure 22:
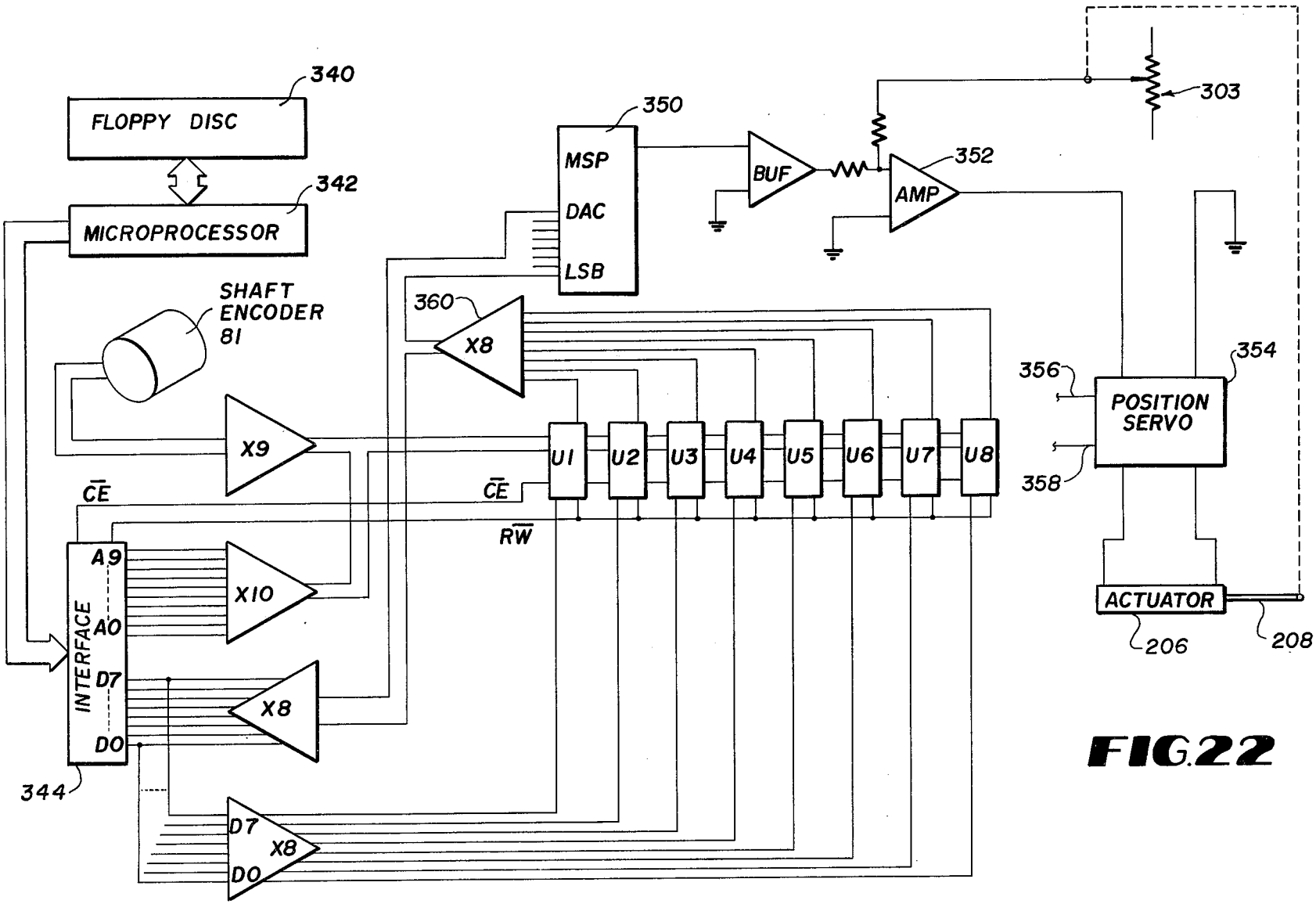

FIG. 4, not sheet 2, discloses a schematic control system utilizing a pair of contact paws in simultaneous engagement with left and right contact switch pads to control angular rotation and lateral movement of left and right lenses to be edge ground;

FIG. 5 is a schematic representation similar to FIG. 4 wherein the lenses have been rotated in the direction of arrows A and B with respect to the position depicted in FIG. 4;

FIG. 6, note sheet 1, is a rear elevational view of the dual head edger including a drive system for controlling rotation of lens blanks and a shaft encoder during an edge grinding operation;

FIG. 7 is a planned view of the dual head edger disclosing a pair of floating heads carrying left and right ophthalmic lenses for a simultaneous grinding operation upon diametrical sides of a central abrading wheel;

FIG. 8, note sheet 3, is an expanded axonometric view of a portion of a floating head assembly including left and right floating heads operable for X—Y coordinate movement;

FIG. 9, note sheet 4, is a bottom view of a base portion of the dual head edger including X—Y motion actuating assemblies and a contact paw positioning device;

FIG. 10, note sheet 5, is a partial detail view of a bevel positioning block and an upper slide pad for positioning lens blanks with respect to the grinding wheel;

FIG. 11, note sheet 4, is an exploded partial axonometric view of a base portion of the dual edger including a set of grinding wheels;

FIG. 12, note sheet 5, is a detail view of a cam assembly which controls air cylinder limit valves in accordance with the invention;

FIG. 13 is an expanded partial axonometric view of a drive system for rotation of a lens blank mounted upon one of the edger floating heads;

FIG. 14 is a plan view of a size adjustment mechanism for positioning a contact switch in relation to a contact paw;

FIG. 15, note sheet 3, is a detail perspective view of a contact paw and a three part switching assembly which controls angular movement of a lens to be edge ground;

FIG. 16 is a perspective view of the three part switching assembly depicted in FIG. 15 wherein a plate holder is pivoted upward to disclose internal details of a dwell contact assembly;

FIG. 17, note sheet 6, is a side elevational view of a control mechanism for positioning left and right contact paws in relation to left and right contact switch plates in accordance with the invention;

FIG. 18, is a side elevational view similar to FIG. 17 in an expanded condition;

FIG. 19 is a detail cross-sectional view taken along section line 19—19 in FIG. 17;

FIG. 20, note sheet 2, is a front view of a microswitch which assists to control termination of the lens edging operation;

FIG. 21 is a side elevational view of the microswitch depicted in FIG. 20; and FIG. 22, note sheet 7, is a schematic representation of a microprocessor control system to regulate and position the location of the left and right contact paws which in turn dictates the edge shape of the lens blanks.

DETAILED DESCRIPTION

Referring now to the drawings and particularly to FIG. 1 thereof, there will be seen an axonometric representation of a dual head edge grinding unit 30 in accordance with a preferred embodiment of the invention. The dual grinding unit 30 includes a lens grinding chamber 32, a left floating head 34 and a right floating head 36. The floating heads are carried by a base member which in turn is supported upon a cabinet 38. The cabinet 38 additionally serves to house a coolant tank and a system pump, not shown. A control panel 40 is mounted above the grinding chamber 32 and is fitted with an appropriate array of units to monitor and control an edge grinding operation.

Before discussing in detail the structural features of the invention, it may be worthwhile to establish in functional terms the general operating concept of the dual edge grinding unit 30. In this regard, the reader's attention is invited in FIGS. 2 through 5, on sheets 1 and 2 of the drawings, where a grinding or abrading diamond wheel 42 is schematically disclosed upon a central longitudinal axis 44. On either side of the first axis 44 are second and third mutually parallel axes 46 and 48 respectively, which in turn extend parallel with the grinding wheel axis 44. A first 50 and second 52 ophthalmic lens to be edge ground is mounted transversely to the axes 46 and 48 respectively and in radial juxaposition to and upon opposite sides of the grinding wheel.

The angular relationship of lenses 50 and 52 with respect to the abrading wheel 42 is controlled by drive units 54 and 56. The drive units are carried by the left and right floating heads 34 and 36.

The drive units 54 and 56 are actuated to rotate the lenses 50 and 52 in response to the lateral position of contact pads 58 and 60 which are also carried by the floating heads 34 and 36. The contact pads extend adjacent contact paws 62 and 64 which are controlled by a microprocessor system in accordance with the invention.

In brief operating sequence the lenses are hold in a rotationally stationary posture and biased against the abrading wheel until the contacts 58 and 60, which are mounted upon the floating heads, engage the processor positioned contact paws. At this point an electrical contact is made and the pattern and lenses are rotated to the next preselected angular position which is preferably less than one degree of angular movement. Contact of the excess glass portion of the lens to be ground away then pushes the floating heads away from the abrading wheel which in turn carries the contact pads 58 and 60 away from contact with paws 62 and 64. When the pads 58 and 60 are withdrawn from the paws 62 and 64 electrical contact is broken and rotation of the lenses ceases. As abrading progresses excess glass at the new angular position is ground away from the lenses 50 and 52 until the pads return to contact with the paws. Electrical contact will again be made and the lenses will be rotated to the next angular position and the sequence will be repeated.

In the above regard, it will be seen, by reference to FIGS. 4 and 5 that the lenses have rotated approximately 270 degrees in the direction of arrows A and B. As the grinding operation progresses the lenses will be stepped about the second and third axes, a full 360 degrees of rotation.

Returning to FIGS. 2 and 3, the abrading wheel 42 may consist of a plurality of individual wheels 66, 68 and 70 which comprise a coarse grinding wheel 66 to rapidly remove excess glass from the lens blank and selective finishing wheels 68 and 70 which simultaneously finalize the overall shape of the lenses and fashion a bevel edge around the periphery of the lenses so that the lenses may be retained within a glasses frame.

Returning to the structural details of the dual edge grinding unit 30, FIG. 6, note sheet 1, discloses an electric motor 72 which serves to operate a primary gear box 74 which in turn is connected to a microswitch gear box 76, an encoder gear box 77, and left and right floating head gear boxes 78 and 80 respectively. The encoder gear box 77 is directly coupled to a shaft encoder 81 which will be discussed more fully below. Another electric motor 82 is mounted within the base cabinet 38 and serves to drive a diamond wheel grinding spindle 84 by a flexible drive belt 86. Air limit valves 88 and 90 are positioned upon opposite sides of a cam control unit 92 which will be discussed more fully below.

Referring now to FIG. 7, there will be seen a top view of the dual head edger 30. The left and right floating heads 34 and 36 are mounted for X—Y coordinate movement upon each side of the abrading wheel 42.

The abrading wheel 42 is mounted upon a firxt axis 44 extending through a support quill 94. Ophthalmic lenses 50 and 52 to be edge ground and chucked and mounted transversely upon mutually parallel axes 46 and 48. Air cylinders 96 and 98 are mounted respectively upon rear stanchions 100 and 102 which in turn are carried by the left and right floating heads 34 and 36. Forward stanchions 104 and 106 are also carried by the floating heads and are positioned along axes 46 and 48 to carry the forward ends of lens shafts 108 and 110 respectively. The lenses 50 and 52 to be edge ground are held in place by felt pads 112 and 114 against chucks 116 and 118 by pressurization of the air cylinders 96 and 98.

A size control unit 124 is mounted upon the left floating head 34 and a similar size control unit 126 is mounted upon the right floating head 36. These size control units terminate at one end with plate holders 128 and 130 designated to carry a plurality of contact plates 58 and 60 which will be discussed more fully below.

Referring specifically to FIG. 8 there will be seen an expanded axonometric view of the floating heads 34 and 36 with respect to an underlying base 132. As previously noted, the left floating head 34 includes a rear stanchion 100 and oppositely positioned forward stanchion 104 which serve to support a first lens to be edge ground. In a similar manner, the right hand floating head 36 includes a rear stanchion 102 and an oppositely positioned forward stanchion 106 which serve to support a second lens to be ground.

The floating head 34 is mounted upon an X—Y coordinate way system carried by the base 132. The head is connected to parallel ways 134 and 136 for translation of the floating head 34 from the front to the rear in a "Y" direction. In a similar manner, ways 134 and 136 are mounted upon normally extending parallel ways 138 and 140 for translation of the floating head 34 along an "X" axis directed laterally with respect to the base 132.

The floating head 36 is also mounted upon an X—Y coordinate way system of ways including a first pair of parallel rods 142 and 144 which serve to permit movement of the floating head 36 in the "Y" direction with respect to the machine. The first pair of ways in turn are mounted upon a second set of ways 146 and 148 which are connected to the base 132 and permit the head 36 to be laterally translated in an "X" direction along the base as desired.

FIG. 9, note sheet 4, discloses a plurality detailed bottom view of the base 132 and includes a system for driving the floating heads upon the above detailed ways in an X—Y rectilinear manner. Lateral or "X" movement of the left floating head 34 is achieved by controlled actuation of the first air motor 150 which is mounted at one end 152 upon the bottom surface of the base 132. A piston portion of the motor 150 extends outwardly from the free end thereof and is connected by a link 154, which extends through an elongated aperture 156, to the bottom surface of the floating head 34.

In a similar manner, a second air motor 158 is mounted at one end 160 directly to the base plate 132. A piston within the air motor 158 extends outwardly from the free end thereof and is connected by a link 162, which extends through an elongated aperture 164 in the base plate to the floating head 36.

The air motors 150 and 158 can be actuated in either direction through air lines connected at the opposite ends thereof. Accordingly, lateral or "X" motion of the floating heads 34 and 36 with respect to the central axis 44 of the cutting head may be controlled in either direction. Moreover, upon application of a predetermined amount of air pressure each of the floating heads may be biased by the motors toward the central axis 44 during a grinding operation.

A third motor 166 is mounted within the base 132. One end of the motor 166 is mounted against a downwardly extending wall of the base 132 as at 168. A piston rod within the motor 166 extends outwardly from the free end thereof and is affixed to a connecting column 170 which is mounted upon a lower slide block 172.

The slide block 172 is free to move within a recess 174 cut into the base 132. An upper slide block 176 is connected to the lower slide block 172 by a spacer column 178 which extends through an elongated aperture 180 in the base plate. Accordingly, the upper and lower slide blocks move in unison upon actuation of the motor 166.

The upper slide block 176 is connected to one side to the floating head 34, note FIG. 10 on sheet 5, by a bevel positioning block 190. The bevel positioning block includes a cantilever arm 192 having downwardly extending roller 194 which projects into an arcuate raceway 196 of the block 180. Accordingly, translation of the upper slide block 176 will serve to concomitantly move the floating head 34 along the previously disclosed guide ways 134 and 136. In a similar manner another bevel position block 200 is connected to the right floating head 36, note FIG. 8 on sheet 3, and includes a roller 202 which is operable to be received within an arcuate raceway 204 of the slide block 176. Translation of the slide block 176 will thus serve to move the floating head 36 along ways 142 and 144.

Referring again to FIG. 9, the base 132 overlays a further fluid motor 206. A piston rod 208 projects from a free end of the motor 206 and is coupled to a long bell crank arm 210. The short bell crank arm 212 is double ended and is provided at each end with a roller. The rollers are received within raceways on opposing faces of sliding contact paws 62 and 64.

Turning now to FIG. 11, there will be seen a partial view of a grinding wheel in an expanded condition. More particularly, the base 132 serves to carry a quill 94 which receives a shaft 214 within bearings 216 in the direction of arrow 218. The shaft 214 is operable to vary a plurality of axially spaced grinding wheels 66, 68, and 70 as previously discussed.

A second shaft 220 is journaled into the quill and carries a worm gear 224 for rotation of the shaft, carrying a cam for cooperation with a microswitch as will be discussed in connection with FIGS. 20 and 21.

In FIG. 12, note sheet 5, there will be seen a cam unit 92 connected to a shaft 226 which in turn is mounted upon the lower slide block 172, note FIG. 9. The actual connection of shaft 226 with the slide block 172, is not shown, but the coupling is a direct one with conventional fasteners. Accordingly, as the floating heads are traversed forward and backward in the "Y" direction the cam unit 92 will move forward and backward and upwardly extending peripheral band 228 of the cam 92 will come in contact with air pressure limit valves 230 and 232. The limit valves are connected to pressurized air conduits 234 and 236 respectively to limit forward and rearward actuation of the cylinder 166 and thus "Y" motion of the floating heads 34 and 36.

Referring now to FIG. 13 there will be seen a rear view of a portion of the right floating head 36 and the rear stanchion 102 which serves to carry an air cylinder 98 for mounting a lens 52 to be ground. The right head gear box 80 is shown in an expanded posture and separated from a first chuck worm gear 240 of a gear train which ultimately connects to shaft 110, note FIG. 7 on sheet 1. Shaft 110 in turn is connected to the lens 52 to be edge ground. Rotation of the chuck worm gear 240 is initialed by a mating worm 242 which in turn is driven by a flexible connector 244 connected to gear box 74. A similar unit is provided on the left floating head 34 to rotate the lens 50.

As previously discussed, a contact plate holder 130 is connected to a size control unit 126 mounted upon the floating head 36. Isometric views of this structure are depicted in FIGS. 15 and 16, note sheet 3. The contact plate holder 130 carries a contact plate 250 which in turn carries a plurality of contact pads 60. The contact plate 250 is pivoted to the holder 130 as at 252 and is biased outwardly from a holder 130 at the free end thereof by a spring 254. A dwell electrical contact bar 256 is carried by the holder 130 and is operable to make electrical contact with a corresponding contact plate 258 carried by the contact plate 250.

Therefore when paw 64 contacts one of the pads 60 the contact plate will pivot, against the bias of spring 254, until electrical contact is established between bar 256 and silvered ball bearing contact 258. At this point in time the lenses will be rotated in a manner which will be discussed more fully below.

Returning now to FIG. 14, note sheet 5, there will be seen a detailed plan view of the size control unit 126. As previously mentioned, this unit is mounted upon floating head 36 and serves to control the size of the lens to be ground for any given pattern shape. In this regard, the contact plate holder 130 is connected to a column 260 which in turn can be laterally adjusted with respect to the floating head 36. This adjustment is provided by rotating a shaft 262 which extends through a collar 264 mounted upon the floating head. Rotation of the shaft is controlled through a set of bevel gears 266 upon rotation of a hand operated control knob 268. A zero position marker 270 is mounted upon thefloating head 36 and serves to register with size control indicia carried by the shaft 260 as at 272. Rotation of the hand control 268 will serve to rotate threaded shaft 262 and advance or retract the contact pads 60 in the directions of arrows 274 with respect to the paw 64.

Turning now to FIGS. 17–19, note sheet 6, there will be seen a system for positioning paws 62 and 64 with respect to contact paws 58 and 60 as previously noted in connection with FIG. 9.

More specifically, contact paw 62 is carried by a frame member 260 which is mounted for "X" reciprocation upon a pair of guide rails 262 and 264. In a similar manner contact paw 64 is carried by a frame member 261. The guide rails are connected at the left and right ends thereof to mounting blocks 266 and 268 which in turn are mounted upon the base 132, note FIG. 19.

A fluid motor 206 is pivotally mounted at one end to the base 132 or an internal wall surface 270 of the edger cabinet 38 as at 272. A piston rod 208 extends from the other end of the motor 206 and is pivotally connected to the long arm 209 of a bell crank 210. A shaft 280 is journaled by sleeve bearings 282 through a wall portion of the base 132 and is fixedly connected at one end of the long arm 209 and at the other end to a mid portion of a double ended short arm 212 of the bell crank 210.

The double ended short arm 212 of the bell crank 210 carries at one end a roller 284 and at the other end a similar roller 286. Rollers 284 and 286 ride within raceways 288 and 300 of the left and right paw supports 260 and 261 respectively.

A rectilinear position potentiometer 303 is mounted at one end to support bracket 268 and the free end of a slide rod 305 is connected to the right support block 261. Accordingly the exact position of the paws 62 and 64 may be monitored which will be discussed more fully below.

In operation the motor serves to reciprocate piston rod 208 which in turn pivots the bell crank about its axis 304. The short bell crank arm 212 then rotates about the axis 304 which pushes the left and right paw supports 260 and 261 away from the axis 304. A fully closed position of the paws is depicted in FIG. 17 and a fully open position is depicted in FIG. 18.

The left 260 ane right 261 paw supports are biased against the rollers 284 and 286 by left and right compression springs 310 and 312. Accordingly as piston rod 208 extends and the rollers are pivoted clockwise from a generally horizontal posture to a generally vertical position the left and right supports carrying paws 62 and 64 will slide together upon the support rails.

Returning now to sheet 2 and FIGS. 20 and 21 there will be seen a microswitch unit 314 which functions to turn off the machine following a grinding operation. The microswitch unit 314 includes a conventional microswitch 316 with a cantilever cam follower 318 which rides upon a cam surface 320 mounted upon shaft 220 as previously mentioned in connection with FIG. 11. Rotation of the cam surface is controlled by a worm gear 224 which in turn is rotated by a worm 322 connected to a drive cable 324 (note FIG. 6).

Regulation of the fluid motor 206 and thus in turn the position of contact paws 62 and 64 is controlled in the subject invention by an electronic computer system. A preferred embodiment of this system is depicted in FIG. 22.

More specifically a floppy disc memory 340 containing a bank of radial dimensional data for a wide variety of lens shapes is interfaced with a microprocessor 342 which feeds through an interface 344 to a plurality of digital memory chips U1–U8.

The shaft encoder 81 reads angular position of the lenses 50 and 52. The encoder 81 continuously addresses the data stored within memory chips U1–U88. Data from the memory chips U1–U8 is input to a digital to analog converter 350. The analog output is fed to a summing amplifier 352 which drives a four-way servo valve 354. Pressurized fluid from lines 356 and 358 is then applied to the motor 206 for positioning the paws 62 to 64 as previously discussed. Actual position of the piston rod 208, slide block 261 and thus paw 64 is monitored by a rectilinear potentiometer 303 which is fed back into the summation amplifier 352 to complete a control loop.

Having now described the major structural features of the subject dual head edger and computerized control system, an overall method of operation entails mounting a pair of lenses 50 and 52 to be edge ground upon shafts 108 and 110 of the floating heads 34 and 36 with the base axes in a horizontal posture at a zero reference point.

The encoder 81 is preferably selected to produce a natural binary output having a resolution of $2^9$ or 512 bytes or absolute positions. Each and every position will output a code relative to that position. That code will be the address in the memory chips U1–U8 for the data which will be the actual radial dimension of a lens, in thousandths of an inch increments, to be ground for that particular spindle shaft and lens angular position.

At the zero reference point, with the lenses having their base axes in a horizontal position the encoder will address the zero location in memory U1–U8 which will input a digital radial lens dimension through buffer 360 to the DAC 350. The analog output reading is amplified and the position servo actuates the motor 206 to drive contact paws 62 and 64 to a relative wide position such as approximately depicted in FIGS. 4 and 18.

The lenses 50 and 52 start out in a circular shape (not shown). The peripheral edges of the lenses impinge upon the rough grinding wheel 66 and because of the excess glass present the floating heads 34 and 36 are held in a posture away from the grinding wheel axis 44 in the "x direction" against the bias of air motors 150 and 158. Since the contact pads 58 and 60 are carried by the floating heads the paws will be initially spaced outwardly away from contact with paws 62 and 64 which, as previously mentioned, are positioned by the motor 206 to the final rough grind radial dimension at the zero angular position. Since the paws do not contact the pads, the spring 254 maintains the electrical contacts 256 and 258 apart. As long as these contacts are separated an electronic (triac) switch is open and the circuit to the motor 82 which simultaneously rotates the lenses and encoder is broken. Accordingly, the lenses will dwell at the zero reference location against the rapidly rotating rough abrading wheel.

As the lenses are ground away at the zero position the air cylinders 150 and 158 continuously bias the floating heads together until the contact pads 58 and 60 are carried into engagement with the contact paws 62 and 64. Upon engaging the contact paws the contact plates swing down until electrical contact is established with the contact bars.

Current is then sent through electronic (triac) switches for the left and right floating heads to start the motor 82 and simultaneously rotate the left and right lenses 50 and 52 and the encoder shaft 220. This rotation will be brief but will continue until the excess glass on the lenses bears against the abrading wheel and pushes the floating heads and contact pads away from the contact paws. Once the pads disengage from the paws electrical contact will be broken and the drive motor 82 will stop.

The encoder addresses the memory chips U1–U8 to the new angular position and a radial dimension will be imputed through the DAC 350 to the servo 354 to reposition the contact paws 62 and 64.

The lenses 50 and 52 will dwell at this new angular orientation until a sufficient amount of the lens is abraded away to enable the pads 58 and 60 to reengage the paws 62 and 64 and the process will be repeated in a stepped sequence 360° around the periphery of the lenses.

At this point in time the cycle is repeated upon a substantially continuous basis wherein the contact pads 58 and 60 remain in continuous engagement with the paws 62 and 64. A timer unit, not shown, times a complete revolution of the encoder and lenses which in turn is synchronized with the microswitch 314. One cycle typically takes about seven seconds. Upon this complete revolution of the paws is continuous contact with the pads and simultaneous complete revolution of the microswitch cam 320 and air cylinders 150 and 158 will be extended to withdraw the lenses radially out of engagement with the coarse grinding wheel 66, note FIGS. 2 and 3 on sheet 1, and the lenses will be translated via cylinder 166 to a predetermined finishing wheel 68 and 70 designed to provide a finishing grind and bevel edge upon the lens.

In this second axial position the process is again repeated in an angular incremental mode until the contact pads remain in engagement with the paws for two complete revolutions as timed by a timer, not shown. Upon two complete revolutions the timer is synchronized with the microswitch 316 to actuate the cylinders 150 and 158 to withdraw the lenses from contact with the abrading wheel and stop the machine.

In a preferred embodiment, as previously noted, the encoder has a resolution of 512 bytes or absolute positions for 360 degrees. The hard memory chips U1–U8 are manufactured by Fairchild Industries, Inc. and are each one bit wide and can store 1024 bits of information.

The lens shape library or radial dimensional data is originally stored in read only memory such as floppy disc 340. Although the encoder addresses 512 absolute locations preferably only 128 bytes of dimensional information will be stored in ROM 340 for each lens shape.

An address code from an operator is input to the microprocessor 342 by means of a decimal keyboard. This will cause a call routine to draw out of ROM 340 128 bytes of dimensional data for a selected lens shape. Upon issuing the call routine this data is placed into the upper 128 locations of the RAM U1–U8 (i.e. 896–1024).

Immediately after the call routine, an interpolation routine is executed. This routine incrementally draws the first byte out of RAM and stores it into location H'00'. It then fetches the next byte, subtracts the first byte from it and divides the difference by four. Byte one plus the quotient is stored in H'01'. Byte one plus two times quotient is stored in H'02'. Byte one plus three times quotient is stored in H'03' and byte two is stored in H'04'. This interpolation routine goes through the entire process of calculation and relocating the data so that it finally occupies the lower 512 locations of the 1024×8 RAM U1–U8.

As discussed previously the shaft encoder can then directly address any of the 512 dimensional data locations for use in generating the selected lens shape.

Upon completion of the data transfer the floppy disc system 340 is left free end and will not normally be addressed again for approximately one minute. Therefore, it is entirely within reason that one floppy disc drive could be accessed by at least twelve to sixteen separate edging machines, allowing one library to be utilized most efficiently.

In describing a method and apparatus for edge grinding opthalmic lenses in accordance with a preferred embodiment of the invention, those skilled in the art will recognize several advantages with singularly distinguish the invention from previously known methods and apparatus.

A particular advantage of the invention is the provision of an electronic control system for an edger which enables ophthalmic lenses to be edge ground without requiring an extensive cam library. Additionally the subject invention eliminates maintenance, storage and retrieval time which is occasioned in utilizing present cam libraries.

The subject invention further provides a shaft encoder utilizing a natural binary output of 512 bytes or absolute positions for each lens. This number of discrete dimensional addresses provides a high degree of accuracy in the resultant lens dimensions.

Because a lens shape code may be input into the system by means of a decimal keyboard instead of setting up cam patterns an operator is easily trained to accurately and efficiently operate the subject equipment. In a similar vein change over time fron one lens shape to the next is significantly enhanced vis-a-vis cam pattern systems.

Still further in a preferred embodiment time utilization of a ROM data library is enhanced by utilization of an interpolation subroutine which requires only 128 bytes of original dimension data.

In describing the invention, reference has been made to a preferred embodiment. Those skilled in the art, however, and familiar with the disclosure of the subject invention, may recognize additions, deletions, modifications, substitutions and/or other changes which will fall within the purview of the subject invention.

What is claimed is:

1. An apparatus for grinding an edge configuration upon at least one ophthalmic lens comprising:

abrading wheel means mounted for rotation about a first axis;

means connected to said abrading wheel means for rotating said abrading wheel means about said first axis;

means for rotatably mounting at least one lens to be edge ground about a second axis;

motor means for translating said second axis toward and away from said first axis for engaging a peripheral portion of said at least one lens with a peripheral portion of said abrading wheel means;

means for rotating said at least one lens about said second axis;

electronic machine means for determining radial dimensions of said at least one lens at predetermined angular positions about the periphery of said at least one lens for a selected lens shape; and means operable in response to a signal from said electronic machine means for controlling the radial position of a peripheral portion of said at least one lens with respect to a peripheral portion of said abrading wheel at said predetermined angular position about the periphery of said at least one lens, said means for controlling the radial position of said at least one lens including, motor means responsive to signals from said electronic machine means, contact means mounted for reciprocation upon a base portion of said apparatus for grinding an edge configuration and being movable in response to said motor means responsive to signals from said electronic machine means;

switch contact means mounted upon said means for rotatably mounting said at least one lens and being positioned adjacent said contact means, and means responsive to contact of said contact means with said switch contact means for controlling rotation of said at least one lens and the radial position thereof with respect to said abrading wheel.

2. An apparatus for grinding an edge configuration upon at least one ophthalmic lens as defined in claim 1 where in said electronic machine means comprises:

means for storing radial dimensional data for at least one lens shape;

means for addressing bytes of data from said means for storing at discrete angular positions of the lenses; and means for translating said addressed data to said means for controlling the radial position of the first and second lenses with respect to said abrading wheel means.

3. An apparatus for grinding an edge configuration upon at least one lens as defined in claim 1 wherein said electronic machine means comprises:

read only memory means for storing 128 bytes of radial dimensional data for each of a plurality of lens shapes;

microprocessor means for calling 128 bytes of dimensional data for a preselected lens shape;

random access memory means for storing the 128 bytes of data;

microprocessor means for interpolating three dimensional data points between each of the 128 bytes of data to produce 512 bytes of data in the random access memory;

means for addressing individual bytes of data from the 512 bytes stored in said random access memory at discrete angular positions of at least one lens; and means for translating said addressed data to said means for controlling radial position of the lens with respect to said abrading wheels means.

4. An apparatus for grinding an edge configuration upon ophthalmic lenses comprising:

abrading wheel means mounted for rotation about a first axis;

means connected to said abrading wheel means for rotating said abrading wheel means about said first axis;

first means for rotatably mounting a first lens to be edge ground about a second axis extending parallel to said first axis;

motor means for translating said second parallel axis toward and away from said first axis for engaging a peripheral portion of the first lens with a peripheral portion of said abrading wheel means;

second means for rotatably mounting a second lens to be edge ground about a third axis extending parallel to said first axis;

motor means for translating said third parallel axis toward and away from said first axis for engaging a peripheral portion of the second lens with another peripheral portion of said abrading wheel means;

means for rotating the first lens about said second axis;

means for rotating the second lens about said third axis;

electronic machine means for determining radial dimensions of each of the first and second lenses at predetermined angular positions about the periphery of each lens for a selected lens shape; and means operable in response to a signal from said electronic machine means for controlling the radial position of a peripheral portion of the first and second lenses with respect to a peripheral portion of said abrading wheel at said predetermined angular positions about the periphery of the first and second lenses, said means for controlling the radial position including, motor means responsive to signals from said electronic machine means, contact means mounted for reciprocation upon a base portion of said apparatus for grinding an edge configuration and being movable in response to said motor means responsive to signals from said electronic machine means, switch contact means mounted upon at least one of said first and second means for rotatably mounting said first and second lenses respectively and being positioned adjacent said contact means, and means responsive to contact of said contact means with said switch contact means for controlling rotation of said first and second lenses and the radial position thereof with respect to said abrading wheel.

5. An apparatus for grinding an edge configuration upon ophthalmic lenses as defined in claim 4 wherein said contact means comprises:

at least one carrier means mounted for reciprocation along said base portion and including, a contact paw mounted upon said at least one carrier means and projecting upwardly to a position adjacent said switch contact means; and means connecting said at least one carrier means to said motor means responsive to signals from said electronic machine means wherein said carrier means translates in response to said motor means responsive to signals from said electronic machine means.

6. An apparatus for grinding an edge configuration upon ophthalmic lenses as defined in claim 5 wherein:

said switch contact means mounted upon at least one of said first and second means for rotatably mounting comprises a switch contact means mounted upon each of said first and second means for rotatably mounting said first and second lenses and being mounted in mutually opposing relation to form opposing switch contact means;

said at least one carrier means comprises a first and second opposed carrier means mounted for reciprocation toward and away from each other upon a common guide rail wherein a contact paw is mounted upon each carrier means and extends between said opposing switch contact means carried by each one of said first and second means for rotatably mounting said first and second lenses; and said means connecting said at least one carrier means to said motor means responsive to signals from said electronic machine means extends between said first and second opposed carrier means and serves to translate both carrier means in response to said motor means responsive to signals from said electronic machine means.

7. An apparatus for grinding an edge configuration upon ophthalmic lenses as defined in claim 6 wherein said means connecting said carrier means to said motor means responsive to signals from said electronic machine means comprises:

a bell crank having a long arm connected to a piston rod of said motor means responsive to signals from said electronic machine means and having a double ended short arm with rollers at each end to ride within raceways fashioned within opposing faces of said first and second opposed carriers; and spring means connected to said first and second opposed carriers for biasing said carriers toward each other.

8. An apparatus for grinding an edge configuration upon ophthalmic lenses as defined in claim 4 where in said electronic machine means comprises:

memory means for storing radial dimensional data for a plurality of lens shapes;

means for reading the radial dimensional data at a plurality of angular positions of first and second lenses; and means for imputing the radial dimensional data to a servo valve for controlling the position of said motor means.

9. An apparatus for grinding an edge configuration upon ophthalmic lenses as defined in claim 4 wherein said electronic machine means comprises:

read only memory means for storing 128 bytes of radial dimensional data for a plurality of lens shapes;

microprocessor means for calling 128 bytes of dimensional data for a preselected lens shape;

random access memory means for storing the 128 bytes of data;

microprocessor means for interpolating three dimensional data points between each of the 128 bytes of data to produce 512 bytes of data in the random access memory;

means for addressing individual bytes of data from the 512 bytes stored in said random access memory at discreet angular positions of the lenses; and means for imputing the radial dimensional data to a servo valve for controlling the position of said motor means.

10. An apparatus for grinding an edge configuration upon ophthalmic lenses as defined in claim 9 wherein said means for addressing comprises:

encoder means having 512 bytes or absolute positions for 360° of rotation and being operable to output a code relative to each position to address said 512 bytes of dimensional data stored in said random access memory means.

11. An apparatus for grinding an edge configuration upon ophthalmic lenses as defined in claim 10 wherein:

said switch contact means mounted upon at least one of said first and second means for rotatably mounting comprises a switch contact means mounted upon each of said first and second means for rotatably mounting said first and second lenses and being mounted in mutually opposing relation to form opposing switch contact means;

said contact means comprises a first and second opposed carrier means mounted for reciprocation toward and away from each other upon a common base mounted guide rail, said contact means each including a contact paw mounted upon each carrier means and extending between said opposing switch contact means carried by each one of said first and second means for rotatably mounting said first and second lenses;

bell crank means having a long arm connected to a piston rod of said motor means and having a double ended short arm with rollers at each end to ride within raceways fashioned within opposing faces of said first and second opposed carrier means; and spring means connected to said first and second opposed carrier means for biasing said carrier means toward each other.

* * * * *